US005611619A

United States Patent [19]

Shen

[11] Patent Number: 5,611,619

[45] Date of Patent: Mar. 18, 1997

[54] MIXING MACHINE

[75] Inventor: Feng-Lien Shen, San-Chung, Taiwan

[73] Assignee: Li Yuan Machine Industrial Co., Ltd., Taipei Hsien, Taiwan

[21] Appl. No.: 671,238

[22] Filed: Jun. 27, 1996

[51] Int. Cl.[6] ..... B01F 7/18; B01F 7/32

[52] U.S. Cl. ..... 366/296; 366/244; 366/286; 366/313

[58] Field of Search ..... 366/295, 296, 366/293, 294, 244, 245, 246, 285, 286, 309, 311, 312, 313, 331

[56] References Cited

U.S. PATENT DOCUMENTS

| | | | |
|---|---|---|---|
| 4,403,868 | 9/1983 | Kupka | 366/295 |
| 4,470,998 | 9/1984 | Paget | 366/295 |
| 4,525,072 | 6/1985 | Giusti | 366/313 |
| 5,102,229 | 4/1992 | Wada et al. | 366/295 |
| 5,421,651 | 6/1995 | Pickering et al. | 366/313 |
| 5,447,372 | 9/1995 | Araki et al. | 366/286 |

*Primary Examiner*—Robert W. Jenkins
*Attorney, Agent, or Firm*—Jacobson, Price, Holman & Stern, PLLC

[57] ABSTRACT

A mixing machine including a machine base, a horizontal suspension arm horizontally suspending above the machine base, a lifting mechanism controlled to move the horizontal suspension arm vertically relative to the machine base, a transmission mechanism mounted on the horizontal suspension arm, a mixing container suspended from the horizontal suspension arm, a mixing blade unit suspending in the mixing container and driven by the transmission mechanism to mix material in the mixing container, wherein: the transmission mechanism includes a horizontal motor and a vertical motor respectively mounted on the horizontal suspension arm, a vertical center spindle coupled to the vertical motor, a horizontal transmission shaft coupled to the horizontal motor, a first sleeve mounted around the vertical center spindle and turned by the horizontal transmission shaft, a second sleeve mounted around the first sleeve and turned by the horizontal transmission shaft in one direction reversed to the first sleeve; the mixing blade unit includes a mixing head fixedly fastened to the bottom end of the vertical center spindle, a first mixing blade assembly fixedly mounted around the first sleeve, a second mixing blade assembly coupled to the second sleeve around the first mixing blade assembly, and a plurality of scrapers respectively mounted around the second mixing blade assembly.

1 Claim, 7 Drawing Sheets

MIXING MACHINE

BACKGROUND OF THE INVENTION

The present invention relates to mixing machines, and relates more particularly to such a mixing machine in which two transmission sleeves are coaxially mounted around a spindle in a hole on the container cover and driven to turn respective mixing blade assemblies in reversed directions.

When making an emulsifying product for example a hair lotion or ointment, powder material and liquid material are put together and then mixed in a mixing machine into an emulsifying condition. Various mixing machines have been disclosed for this purpose. In order to prevent air from being mixed with materials, materials must be mixed in a mixing container which is maintained in a vacuum status. The mixing blade unit of a mixing machine for mixing materials in a mixing container having no air in it, is generally comprised of three mixing heads. One of the mixing head is suspending in the mixing container near the bottom and coupled to a bottom transmission shaft, which is inserted through a hole in the bottom side of the mixing container and driven by a motor, which is disposed below the mixing container. The other two mixing heads are disposed below the container cover and coupled to a top transmission shaft, which is inserted through a hole in the container cover and driven by a motor, which is disposed above the container cover. When materials are put in the mixing container, the container cover is closed on the mixing container, then air is drawn away from the mixing container, and then the top transmission shaft and the bottom transmission shaft are simultaneously driven to turn the mixing heads, permitting the materials to be mixed into an emulsifying condition. Because the bottom transmission shaft is inserted into the mixing container from the bottom side to hold one mixing head inside the mixing container, it is difficult to clean the inside of the mixing container during a maintenance work. When to pour well mixed substance out of the mixing container, the mixing container with the bottom transmission shaft and the related motor must be simultaneously turned about the horizontal pivot means on which the mixing container is mounted. Because the whole assembly of the mixing container, the bottom transmission shaft and the related motor is heavy, it is not easy to pour well mixed substance out of the mixing container. Because the mixing heads are not disposed in contact with the inside wall of the mixing container, materials tend to be adhered to the inside wall of the mixing container. When the inside wall of the mixing container is covered with a layer of emulsion, the cleaning work becomes more difficult. Furthermore, in regular mixing machines, the container cover is fastened to a horizontal suspension arm, which is suspended above the machine base and moved vertically relative to the machine base by a lifting mechanism. When the horizontal suspension arm is moved up and down relative to the machine base, the bellows tube which is coupled between the horizontal suspension arm and a vacuum pump in the machine base tends to be stretched and damaged. If the bellows tube is ruptured, air cannot be effectively drawn away from the mixing container. Furthermore, before opening the container cover, the inside pressure of the mixing container must be released. Therefore, a release valve means must be installed. However, the installation of a release valve means complicates the structure of the mixing machine, and relatively increases the manufacturing cost of the mixing machine.

SUMMARY OF THE INVENTION

The present invention has been accomplished to provide a mixing machine which eliminates the aforesaid drawbacks. According to one aspect of the present invention, the mixing machine comprises a machine base, a horizontal suspension arm horizontally suspending above the machine base, a lifting mechanism controlled to move the horizontal suspension arm vertically relative to the machine base, a transmission mechanism mounted on the horizontal suspension arm, a mixing container suspended from the horizontal suspension arm, a container cover fastened to the horizontal suspension arm and adapted for closing the mixing container, a mixing blade unit suspending in the mixing container and driven by the transmission mechanism to mix material in the mixing container, wherein: the transmission mechanism includes a horizontal motor and a vertical motor respectively mounted on the horizontal suspension arm, a vertical center spindle coupled to the vertical motor, a horizontal transmission shaft coupled to the horizontal motor, a first sleeve mounted around the vertical center spindle and turned by the horizontal transmission shaft, a second sleeve mounted around the first sleeve and turned by the horizontal transmission shaft in one direction reversed to the first sleeve; the mixing blade unit includes a mixing head fixedly fastened to the bottom end of the vertical center spindle, a first mixing blade assembly fixedly mounted around the first sleeve, a second mixing blade assembly coupled to the second sleeve around the first mixing blade assembly. According to another aspect of the present invention, a plurality of scraper holders are respectively mounted around the second mixing blade assembly to hold a respective scraper. When the mixing blade unit is turned to mix materials in the mixing container, the scrapers of the scraper holders are moved along the inside wall of the mixing container to scrape substance from it. According to still another aspect of the present invention, a quick connector is connected between the horizontal suspension arm, and coupling to vacuum pump means adapted for drawing air out of the mixing container. The quick connector is comprised of a first connector fixedly mounted on the horizontal suspension arm, and a second connector fixedly mounted on the machine base. When the horizontal suspension arm is lifted to open the container cover from the mixing container, the first connector is simultaneously disconnected from the second connector for permitting air pressure to be quickly released.

DETAILED DESCRIPTION OF THE PREFERRED EMBODIMENT

Figure 1:
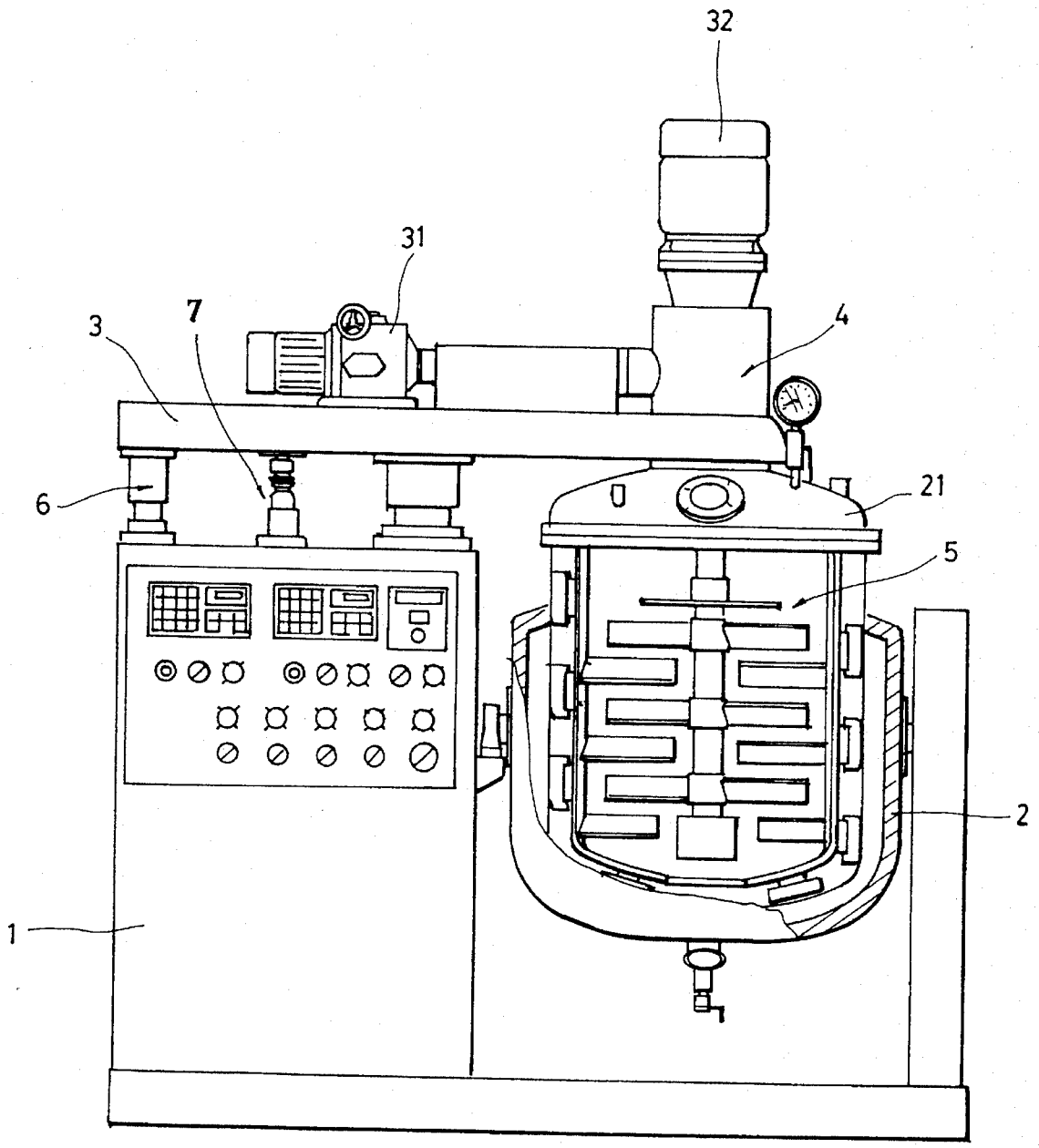
FIG. 1 is a front view in plain of a mixing machine according to the present invention.

Referring to FIG. 1, a mixing machine in accordance with the present invention is generally comprised of a machine base 1, a horizontal suspension arm 3 horizontally suspending above the machine base 1, a quick connector 7 connected between the machine base 1 and the horizontal suspension arm 3, a lifting mechanism 6 connected between the machine base 1 and the horizontal suspension arm 3 and trolled to move the horizontal suspension arm 3 vertically relative to the machine base 1, a transmission mechanism 4 mounted on the free end of the horizontal suspension arm 3, a mixing container 2 suspended from the free end of the horizontal suspension arm 3 and covered with a container cover 21, a mixing blade unit 5 suspending in the mixing container 2 and coupled to the transmission mechanism 4, a horizontal motor 31 and a vertical motor 32 respectively mounted on the horizontal suspension arm 3 and controlled to turn the transmission mechanism 4.

Figure 2:
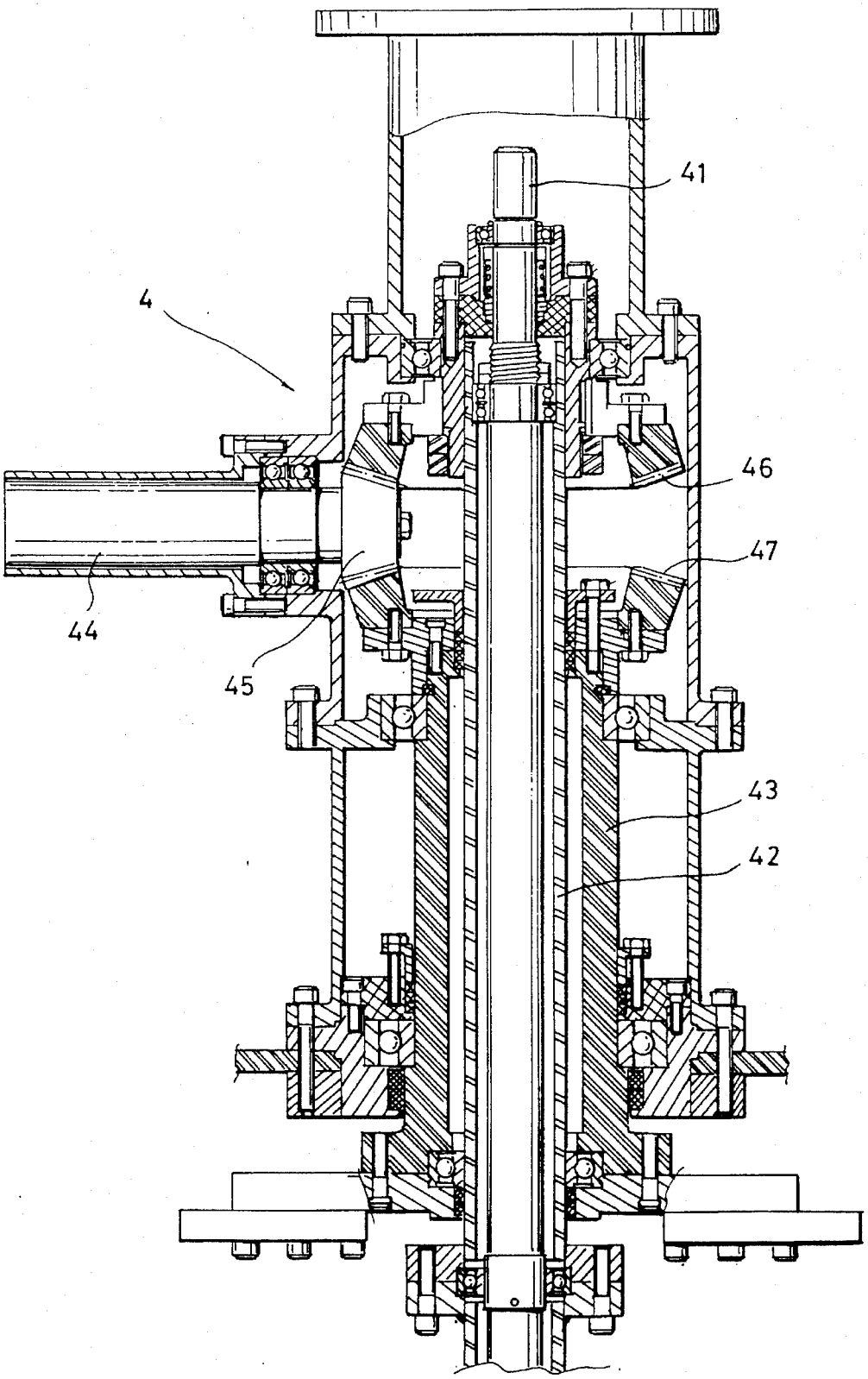
FIG. 2 is a sectional view in an enlarged scale of the transmission mechanism of the mixing machine shown in FIG. 1.

Referring to FIG. 2 and FIG. 1 again, the transmission mechanism 4 comprises a center spindle 41, a first sleeve 42 mounted around the center spindle 41, a second sleeve 43 mounted around the first sleeve 42, a horizontal transmission shaft 44, a driving bevel gear 45 fixedly mounted around the horizontal transmission shaft 44 at one end, a first driven bevel gear 46 and a second driven bevel gear 47 respectively mounted on the first sleeve 42 and the second sleeve 43 at the top through which the first sleeve 42 and the second sleeve 43 are rotated by the horizontal transmission shaft 44.

Figure 3:
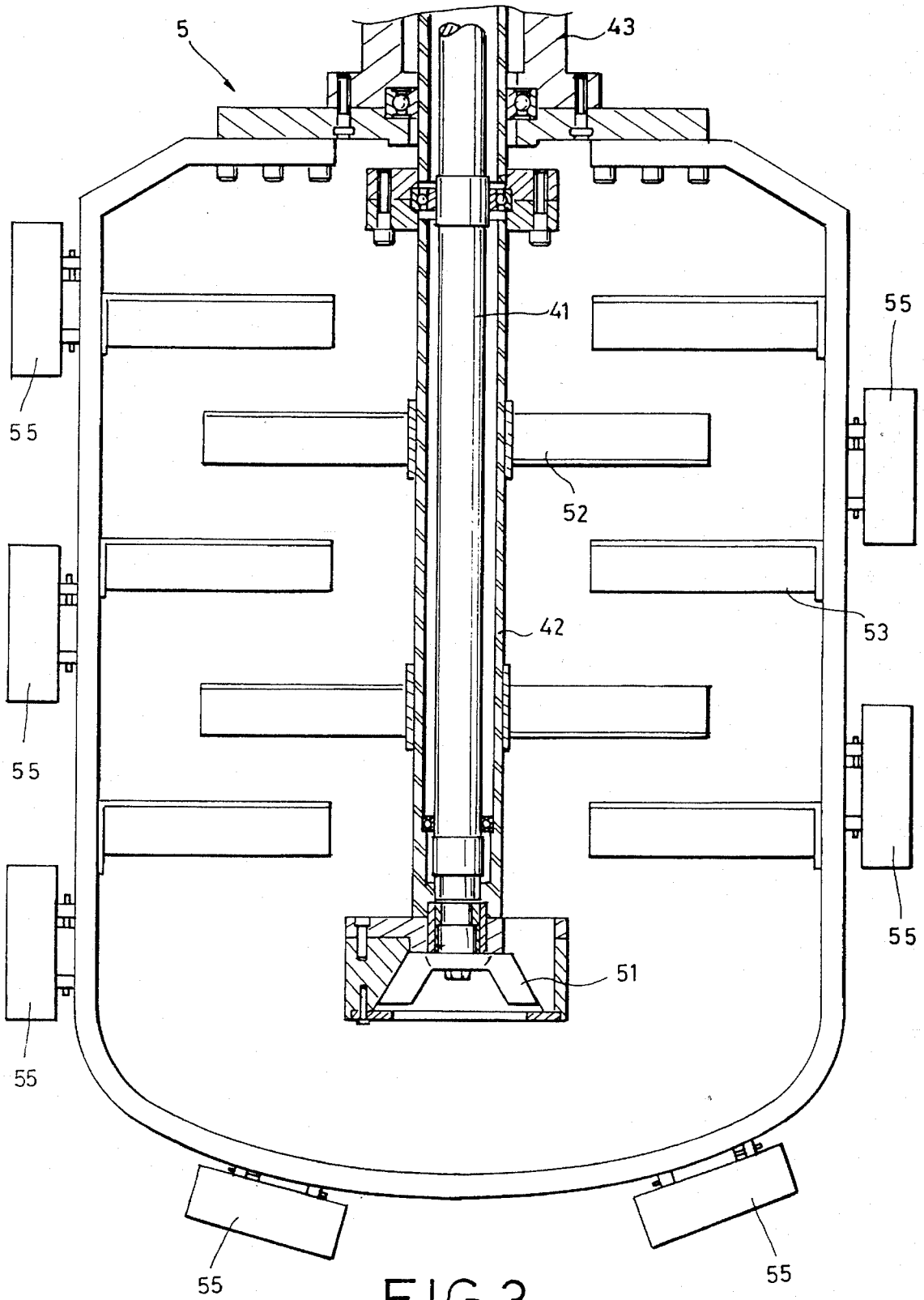
FIG. 3 is a sectional view in an enlarged scale of the mixing container and mixing blade unit of the mixing machine shown in FIG. 1.
Figure 4:
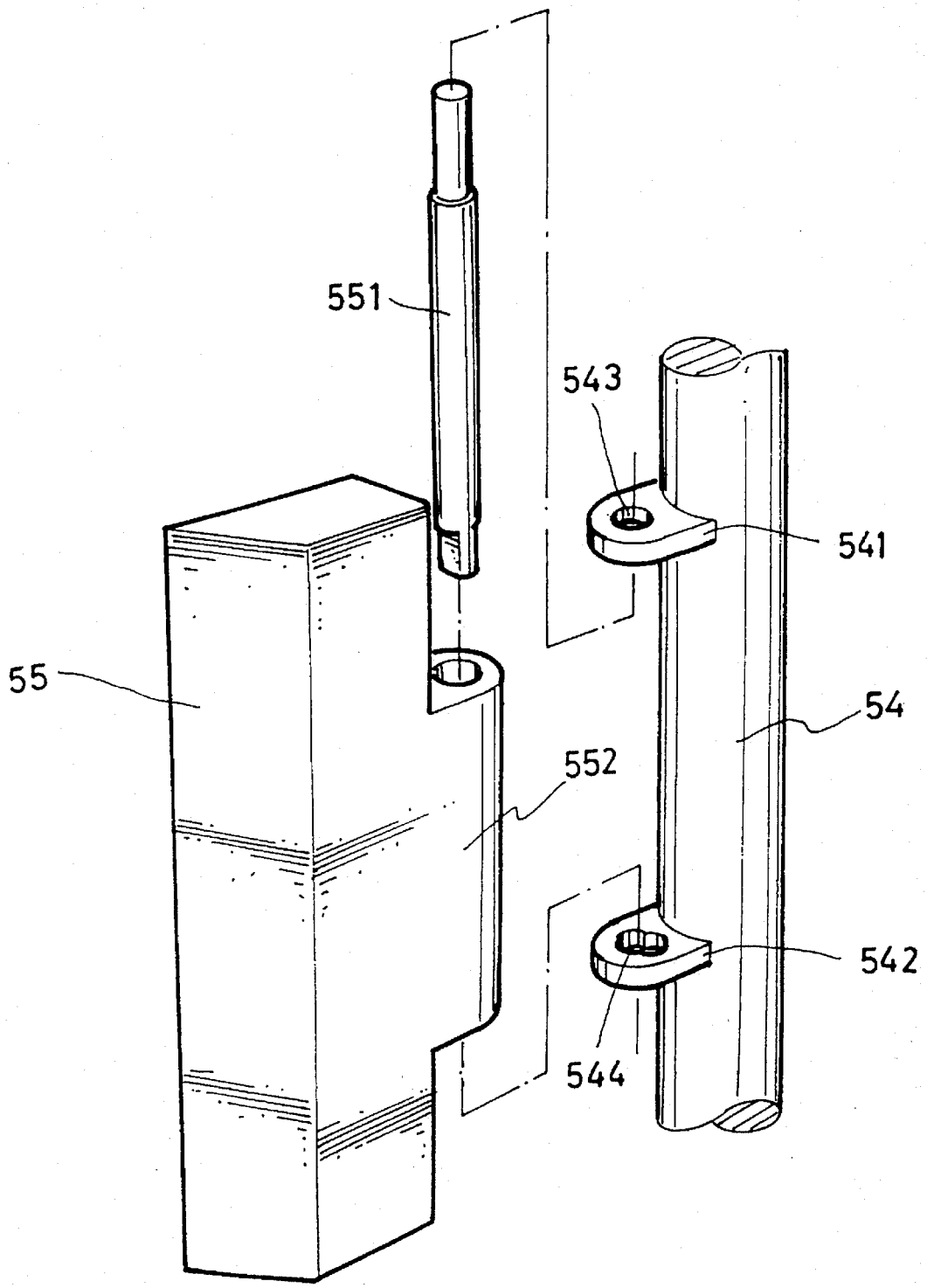
FIG. 4 is an exploded view of a scraper holder and a scraper according to the present invention.

Referring to FIGS. 3 and 4, the mixing blade unit 5 comprises a mixing head 51 fastened to the bottom end of the center spindle 41 of the transmission mechanism 4, a first mixing blade assembly 52 mounted around the first sleeve 42 of the transmission mechanism 4, a second mixing blade assembly 53 coupled to the second sleeve 43 around the first mixing blade assembly 52, a plurality of scraper holders 54 respectively mounted around the second mixing blade assembly 53, and a plurality of scrapers 55 respectively fastened to the scraper holders 54. As illustrated in FIG. 3, each of the scraper holders 54 comprises two a first lug 541 having an axle hole 543, and a second lug 542 having a crossed locating hole 544. A pivot shaft 511 is connected between the lugs 541, 542 to hold one scraper 55, having two opposite ends respectively fastened to the axle hole 543 of the first lug 541 and the crossed locating hole 544 of the second lug 42. The scraper 55 has a barrel 552 at one side coupled to the pivot shaft 551. When installed, the scraper 55 can be turned about the pivot shaft 551.

Figure 5:
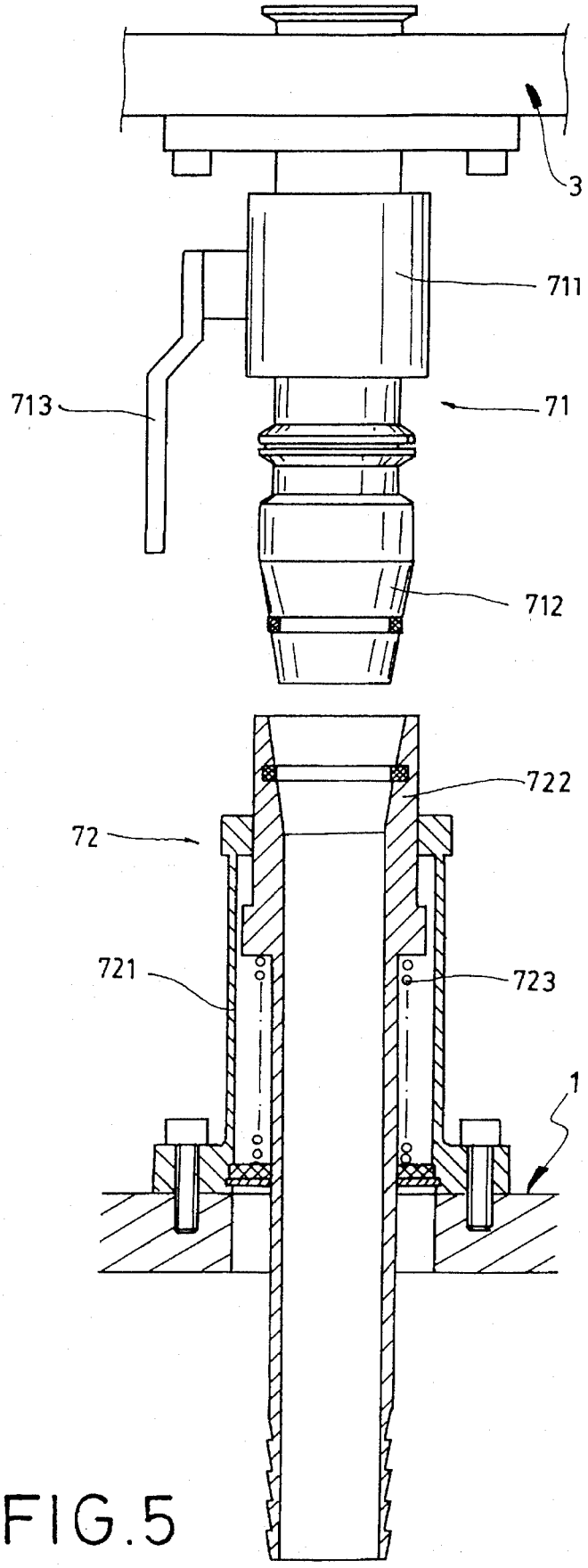
FIG. 5 is a sectional view in an enlarged scale of the quick connector of the mixing machine shown in FIG. 1.

Referring to FIG. 5, the quick connector 7 is comprised of a first connector 71 connected to the horizontal suspension arm 3, and a second connector 72 connected to the machine base 1. The first connector 71 comprises a mount 711 fastened to the horizontal suspension arm 3 at the bottom, a socket 712 fastened to the mount 711 at the bottom, and a downward locating rod 713 raised from the periphery of the mount 711. The second connector 72 comprises a hollow mount 721 fastened to the machine base 1 at the top, a spring 723 mounted inside the hollow mount 721, and a socket 722 slidably mounted in the hollow mount 721 at the top and supported on the spring 723.

Referring to Figures from 1 to 4 again, the horizontal transmission shaft 44 is coupled to the horizontal motor 31. When the horizontal transmission shaft 44 is rotated by the horizontal motor 31, the drive bevel gear 45 is driven to turn the first driven gear 46 and the second driven gear 47 in reversed directions, thereby causing the first sleeve 42 and the second sleeve 43 to be rotated relative to each other in reversed directions. When the first sleeve 42 and the second sleeve 43 are rotated, the first mixing blade assembly 52 and the second mixing blade assembly 53 are rotated to mix material contained in the mixing container 2. The center spindle 41 is coupled to the vertical motor 32. When the vertical motor 32 is started, the mixing head 51 is turned by the center spindle 41 to mix material in the mixing container 2.

Figure 6:
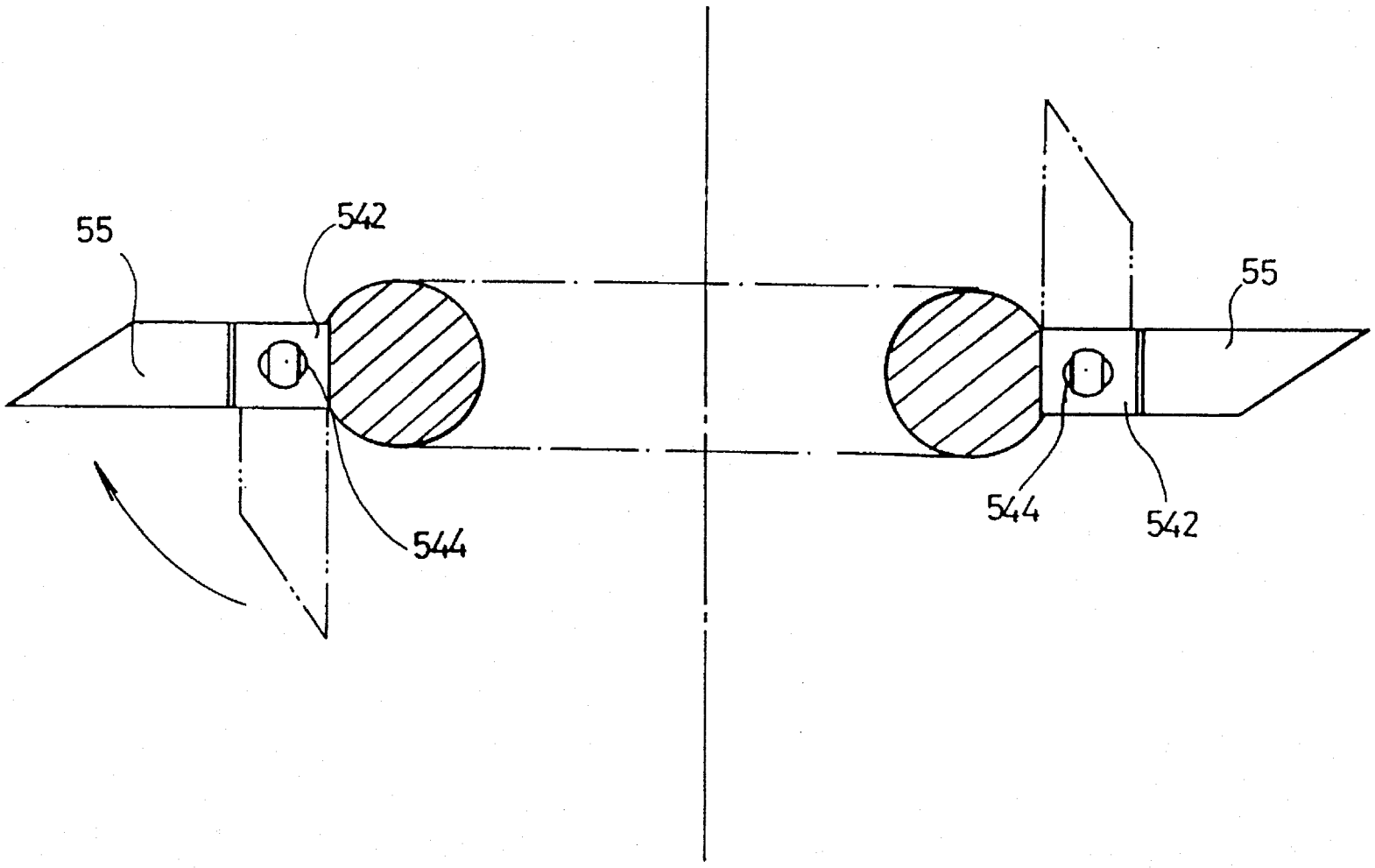
FIG. 6 is a schematic drawing showing the scrapers turned about the respective pivot shaft according to the present invention.

Referring to FIG. 6, and FIGS. 3 and 4 again, the scrapers 55 are respectively turned about the pivot shafts 54 of the respective scraper holders 54. When the second mixing blade assembly 53 is rotated, the scrapers 55 are forced outwards by the flowing resistance of the mixing fluid to closely attach to the inside wall of the mixing container 2 and to scrap residual substance from it. Because the pivot shaft 551 has a flat bottom end fastened to the crossed locating hole 544 of the second lug 542 of the respective scraper holder 54, the pivot shaft 551 does not turn with the respective scraper 55 when the respective scraper 55 is forced by the flowing resistance of the mixing fluid to tilt toward the inside wall of the mixing container 2.

Figure 7:
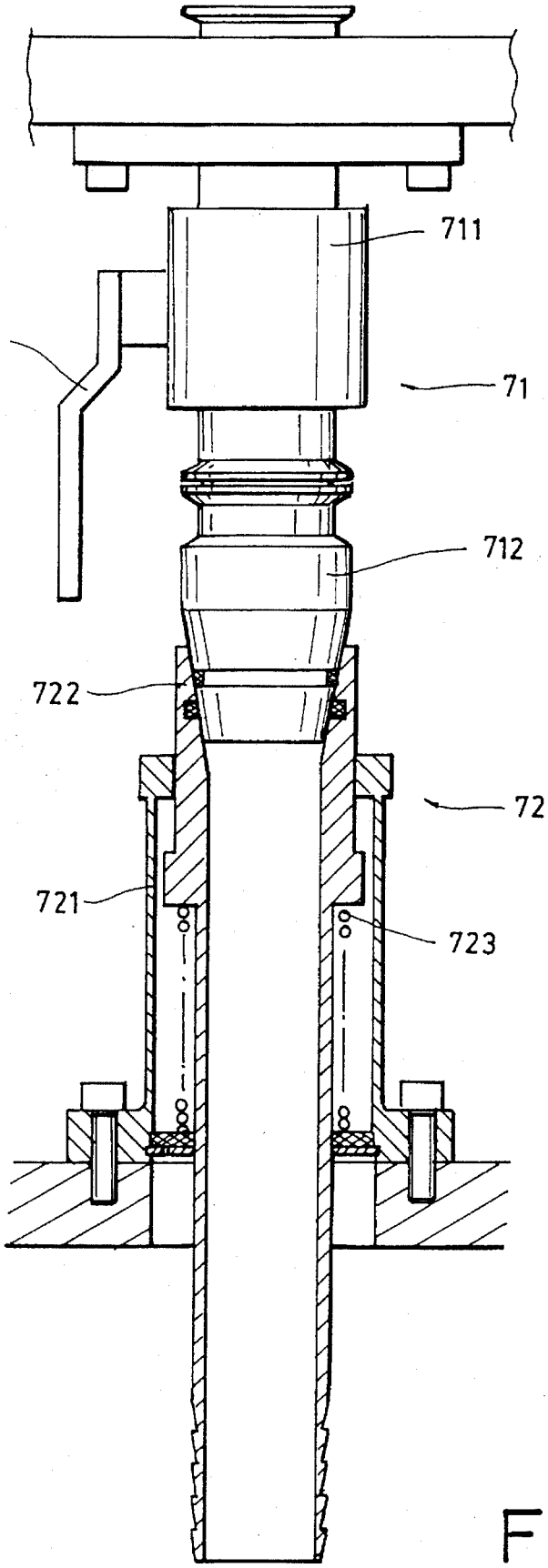
FIG. 7 is similar to FIG. 5 but showing the first connector disconnected from the second connector.

Referring to FIG. 7 and FIG. 1 again, when the horizontal suspension arm 3 is lifted from the machine base 1 by the lifting mechanism 6, the container cover 21 is lifted from the mixing container 2, and at the same time, the first connector 71 is lifted from the second connector 72. On the contrary, when the horizontal suspension arm 3 is lowered, the container cover 21 is covered on the mixing container 2, and the first connector 71 is coupled to the second connector 72, and air can then be drawn away from the mixing container 2 through the quick connector 7, and then the mixing operation can be started. When the first connector 71 is lowered and attached to the second connector 72, the spring 723 imparts an upward pressure to the second connector 72, thereby causing the second connector 72 to be firmly attached to the first connector 71, and at the same time, the downward locating rod 713 is stopped against the machine base 1 to hold the first connector 71 in position. After mixing, the horizontal suspension arm 3 is lifted from the machine base 1 to open the container cover 21 from the mixing container 2, and simultaneously to disconnect the first connector 71 from the second connector 72 for allowing air pressure to be released.

While only one embodiment of the present invention has been shown and described, it will be understood that various modifications and changes could be made without departing from the spirit and scope of the invention disclosed.

What is claimed is:

1. A mixing machine comprising a machine base, a horizontal suspension arm horizontally suspending above said machine base, a lifting mechanism connected between said machine base and said horizontal suspension arm and trolled to move said horizontal suspension arm vertically relative to said machine base, a transmission mechanism mounted on said horizontal suspension arm, a mixing container suspended from said horizontal suspension arm, a container cover fastened to said horizontal suspension arm and adapted for covering on said mixing container, and a mixing blade unit suspending in said mixing container and coupled to the transmission mechanism, wherein: said transmission mechanism comprises a horizontal motor and a vertical motor respectively mounted on said horizontal suspension arm, a vertical center spindle having a top end coupled to said vertical motor and a bottom end suspending in said mixing container, a horizontal transmission shaft having one end coupled to said horizontal motor and an opposite end fixedly mounted with a drive bevel gear, a first sleeve mounted around said vertical center spindle and turned on its own axis by said horizontal transmission shaft, said first sleeve having a top end fixedly mounted with a driven bevel gear meshed with said drive bevel gear, and a second sleeve mounted around said first sleeve and turned by said horizontal transmission shaft on its own axis in one direction reversed to the turning direction of said first sleeve, said second sleeve having a top end fixedly mounted with a driven bevel gear meshed with said drive bevel gear; said mixing blade unit comprises a mixing head fixedly fastened to the bottom end of said vertical center spindle, a first mixing blade assembly mounted around said first sleeve, and a second mixing blade assembly coupled to said second sleeve around said first mixing blade assembly.

* * * * *